US010830175B2

(12) United States Patent
De Blok

(10) Patent No.: US 10,830,175 B2
(45) Date of Patent: Nov. 10, 2020

(54) THERMOACOUSTIC ENERGY CONVERSION SYSTEM

(71) Applicant: SoundEnergy B.V., Enschede (NL)

(72) Inventor: Cornelis Maria De Blok, Veessen (NL)

(73) Assignee: SOUNDENERGY B.V., Enschede (NL)

( * ) Notice: Subject to any disclaimer, the term of this patent is extended or adjusted under 35 U.S.C. 154(b) by 12 days.

(21) Appl. No.: 15/759,881

(22) PCT Filed: Sep. 17, 2015

(86) PCT No.: PCT/NL2015/050640
§ 371 (c)(1),
(2) Date: Mar. 14, 2018

(87) PCT Pub. No.: WO2017/048116
PCT Pub. Date: Mar. 23, 2017

(65) Prior Publication Data

US 2018/0238266 A1 Aug. 23, 2018

(51) Int. Cl.
*F02G 1/057* (2006.01)
*F25B 9/14* (2006.01)

(52) U.S. Cl.
CPC ..... *F02G 1/057* (2013.01); *F25B 9/14* (2013.01); *F25B 9/145* (2013.01); *F25B 2309/1412* (2013.01); *F25B 2309/1415* (2013.01)

(58) Field of Classification Search
CPC .... F02G 1/057; F25B 2309/1412; F25B 9/14; F25B 9/145
See application file for complete search history.

(56) References Cited

U.S. PATENT DOCUMENTS 4,114,380 A * 9/1978 Ceperley ..... F02G 1/0435 60/721
5,813,234 A * 9/1998 Wighard ..... F02G 1/0435 62/467
5,857,340 A * 1/1999 Garrett ..... F25B 9/145 62/467
8,806,875 B2 * 8/2014 Watanabe ..... F25B 9/145 62/6
2003/0192324 A1 10/2003 Smith et al.
(Continued)

FOREIGN PATENT DOCUMENTS

CN 101282074 A 10/2008
CN 101713577 A 5/2010
(Continued)

OTHER PUBLICATIONS

PCT International Search Report and Written Opinion for PCT/NL2015/050640 dated May 27, 2016.
(Continued)

*Primary Examiner* — Shafiq Mian

(57) ABSTRACT

A thermoacoustic energy conversion system includes a closed circumferential encasing filled with a working fluid through which an acoustic wave can propagate in a propagation direction in use of the system, and at least one assembly of two heat exchangers with a regenerator sandwiched there-between arranged in said encasing. The at least one assembly is arranged substantially parallel to a local longitudinal axis of the encasing.

13 Claims, 6 Drawing Sheets

(56) References Cited

U.S. PATENT DOCUMENTS

| | | | | |
|---|---|---|---|---|
| 2005/0028535 | A1* | 2/2005 | Poese | F02G 1/0435 62/6 |
| 2006/0119224 | A1* | 6/2006 | Keolian | H01L 41/113 310/339 |

FOREIGN PATENT DOCUMENTS

| | | | | |
|---|---|---|---|---|
| WO | 99/20957 | A1 | 4/1999 | |
| WO | 199920957 | A1 | 4/1999 | |
| WO | WO-2010107308 | A1 * | 9/2010 | F02G 1/043 |
| WO | 2014135895 | A1 | 9/2014 | |

OTHER PUBLICATIONS

PCT second Written Opinion for PCT/NL2015/050640 dated Sep. 13, 2017.

PCT International Preliminary Report on Patentability for PCT/NL2015/050640 dated Dec. 7, 2017.

* cited by examiner

THERMOACOUSTIC ENERGY CONVERSION SYSTEM

"This is a national stage application filed under 35 U.S.C. 371 of pending international application PCT/NL2015/050640, filed Sep. 17, 2015, the entirety of which application is incorporated by reference herein."

The invention relates to a Thermoacoustic energy conversion system, comprising:

- a closed circumferential encasing that is filled with a working fluid through which an acoustic wave can propagate in a propagation direction in use of the system, and
- at least one assembly of two heat exchangers with a regenerator sandwiched there between arranged in said encasing.

Such a system is for example known from the international patent application WO99/20957. The system of WO99/20957 comprises an acoustic or mechanical-acoustic resonator circuit and a regenerator clamped between two heat exchangers. The heat exchangers can be connected to external gas or liquid circuits for feeding a heat exchange fluid thereto, by means of which heat is supplied to or drained from the heat exchangers. Said system may be used either as a heat pump or as an engine. If said system is used as a heat pump, the working fluid is brought into oscillation, for example by means of a said engine, bellows, a free piston construction, a Helmholz resonator, or any other suitable means. By means of the oscillating working fluid heat is transferred from one heat exchanger to the other heat exchanger, such that the system can be used for refrigeration or heating. If said system is used as an engine, heat is supplied to the one heat exchanger and heat is drained at the other heat exchanger. This causes the working fluid to oscillate, which oscillation can be maintained by a continuous heat supply at the one heat exchanger and heat drainage at the other heat exchanger. The oscillating working fluid may for example be used as said oscillating means for the heat pump and/or may for example be converted into electrical energy.

As said heat exchange fluid flows trough each heat exchanger, the heat exchange fluid cools down in the one heat exchanger and heats up in the other heat exchanger. As such, the temperature of the heat exchange fluid at an inlet side of each heat exchanger differs from the temperature of the heat exchange fluid at an outlet side of each heat exchanger. This radial non-uniform temperature gradient influences the acoustic wave traveling through the heat exchangers and will induce unwanted radial acoustic r and thermal flows inside the assembly, thereby negatively affecting the performance thereof.

Attempts have been made to overcome this advantage and are know from literature. However, these attempts, including flow straighteners as well as circular (radial) exchangers have not yet been successful.

It is an object of the invention to at least partially overcome said above disadvantage and/or to improve the system disclosed in WO99/20957.

This object is achieved by a system according to the preamble that is in accordance with the invention characterized in that said at least one assembly is arranged substantially parallel to a local longitudinal axis of said encasing.

By arranging the assembly parallel to the local longitudinal axis of said encasing, instead of orthogonal as is the case for the system disclosed in WO99/20957, the velocity, in particular the acoustic impedance, of the acoustic wave along the assembly is matched to the longitudinal non-uniform temperature profile along the assembly, thereby providing a more or less uniform power density along the assembly, thereby preventing or at least reducing said unwanted radial acoustic power and thermal flows inside the assembly. In particular, the velocity, respectively the acoustic impedance, of the acoustic wave increases, respectively decreases, from an upstream end towards a downstream end of the assembly as seen in the propagation direction of the acoustic wave, and the temperature gradient across the regenerator decreases from said upstream end towards said downstream end of the assembly, which will yield said more or less constant power density along the assembly.

It is noted that said acoustic wave propagates in the local longitudinal direction of said encasing in a propagation direction. Said assembly is thus arranged parallel to the propagation direction of the acoustic wave.

It is further noted that said encasing takes a substantially circumferential or looped form, such that the direction of the longitudinal axis of the encasing varies over the length of the encasing. The assembly is arranged such that it is arranged substantially parallel to the local longitudinal axis of said encasing.

Said working fluid may in particular be a gas. Said gas is preferably a gas with a relatively high ratio $\gamma$ between heat capacity at constant pressure and heat capacity at constant volume. The ratio $\gamma$ is preferably at least 1.4. For example air or nitrogen are suitable gasses having a ratio $\gamma$ of approximately 1.4. Air as said gas has the additional advantage that it easy in use. The ratio $\gamma$ is even more preferably around 1.6, which includes all inert gasses like helium, hydrogen or argon.

Said regenerator may be any suitable known regenerator, and is usually made of a porous material with good heat exchange properties.

In an embodiment of the thermoacoustic energy conversion system according to the invention, said system comprises a first blocking means arranged in said encasing for blocking a first part of the cross-sectional area of the encasing upstream of said assembly as seen in said propagation direction, and comprising a second blocking means arranged in said encasing for blocking a second, opposite part of the cross-sectional area of the encasing downstream of said assembly as seen in said propagation direction, wherein said first and second blocking means are arranged to prevent said acoustic wave from bypassing said assembly and to direct the acoustic wave in a directing direction to first pass a first heat exchanger of the two heat exchangers and then, via the regenerator, the second heat exchanger of the two heat exchangers.

In accordance with the invention the assembly is arranged parallel to the local longitudinal axis of said encasing. However, as a result of this arrangement the acoustic wave may bypass the assembly. The first and second blocking means prevent such bypass of the acoustic wave and direct the acoustic wave in such a manner that is first passes the first heat exchanger and then, via the regenerator, the second heat exchanger.

The first blocking means are preferably arranged directly upstream of said assembly.

The second blocking means are preferably arranged directly downstream of said assembly.

In another embodiment of the thermoacoustic energy conversion system according to the invention said first blocking means gradually rises from an inner wall of the encasing in the propagation direction, thereby guiding said acoustic wave in said directing direction.

Guiding the acoustic wave in the directing direction results in a relatively high efficiency of the system.

In another embodiment of the thermoacoustic energy conversion system according to the invention said second blocking means gradually decreases towards the inner wall of the encasing in the propagation direction, thereby guiding said acoustic wave in the propagation direction.

Guiding the acoustic wave that leaves the assembly in the propagation direction results in a relatively high efficiency of the system.

In yet another embodiment of the thermoacoustic energy conversion system according to the invention said encasing has an increased cross-sectional size in in the area of said assembly with respect to other parts of said encasing, wherein upstream of said assembly as seen in said propagation direction the cross-sectional size of the encasing gradually increases to said increased size, and wherein downstream of said assembly as seen in said propagation direction the cross-sectional size of the encasing gradually decreases to its size in said other parts, wherein said first blocking means and/or said second blocking means is/are arranged in the gradually increasing part, respectively decreasing part of said encasing, and wherein said first blocking means and/or said second blocking means gradually rises, respectively decreases in such a manner that the cross-sectional through flow area of said encasing in said increasing part, respectively decreasing part remains substantially constant over the length of the first and/or second blocking means and is substantially equal to a cross-sectional through flow area in said other parts of the encasing.

An advantage of said substantially constant through flow area over the length of the blocking means that is substantially equal to a cross-sectional through flow area in said other parts of the encasing is that there is substantially no change in through flow area that could influence the acoustic wave.

In yet another embodiment of the thermoacoustic energy conversion system according to the invention said encasing has an or said increased cross-sectional size in in the area of said assembly with respect to (said) other parts of said encasing, wherein upstream of said assembly as seen in said propagation direction the cross-sectional size of the encasing gradually increases to said increased size, and wherein downstream of said assembly as seen in said propagation direction the cross-sectional size of the encasing gradually decreases to its size in said other parts, and wherein a cross-sectional through flow area defined between the inner wall of the encasing and the first heat exchanger and/or between the inner wall of the encasing and the second heat exchanger is substantially equal to a cross-sectional through flow area in said other parts of the encasing.

An advantage of said cross-sectional through flow area that is substantially equal to the cross-sectional through flow area in said other parts of the encasing is that there is substantially no change in through flow area that could influence the acoustic wave.

In yet another embodiment of the thermoacoustic energy conversion system according to the invention the inlet for feeding a heat exchange fluid to the first heat exchanger is arranged at an upstream end of the first heat exchanger as seen in the propagation direction, wherein the outlet for discharging said heat exchange fluid from the first heat exchanger is arranged at a downstream end of the first heat exchanger as seen in the propagation direction.

In the first heat exchanger the heat exchange fluid absorbs heat, such that the temperature of the heat exchange fluid is lower at the inlet than at the outlet. By arranging the inlet at the upstream end and the outlet at the downstream end of the first heat exchanger, the temperature gradient is larger at the inlet than at the outlet, such that the temperature gradient matches the acoustic impedance as described above.

In yet another embodiment of the thermoacoustic energy conversion system according to the invention the inlet for feeding a heat exchange fluid to the second heat exchanger is arranged at an upstream end of the second heat exchanger as seen in the propagation direction, wherein the outlet for discharging said heat exchange fluid from the second heat exchanger is arranged at a downstream end of the second heat exchanger as seen in the propagation direction.

In this embodiment, the assembly functions as an engine.

In yet another embodiment of the thermoacoustic energy conversion system according to the invention the inlet for feeding a heat exchange fluid to the second heat exchanger is arranged at a downstream end of the second heat exchanger as seen in the propagation direction, wherein the outlet for discharging said heat exchange fluid from the second heat exchanger is arranged at an upstream end of the second heat exchanger as seen in the propagation direction.

In this embodiment, the assembly functions as a heat pump.

In yet another embodiment of the thermoacoustic energy conversion system according to the invention said system comprises a plurality of said assemblies that are spaced apart in the longitudinal direction of said encasing, preferably by equal spacing distances.

Practically, a part of said plurality of said assemblies function as an engine, that provide the power for the other part of said plurality of said assemblies that function as a heat pump.

Said system may comprise any suitable number of assemblies, for example two or four assemblies.

In yet another embodiment of the thermoacoustic energy conversion system according to the invention a length of the or each assembly is at least 5%, preferably at least 10%, more preferably at least 15% of the average total circumferential length of the encasing.

The invention will be further elucidated with reference to figures shown in a drawing, in which.

It is noted that the same components are designated in the figures with the same reference numerals, but increased by 100.

Figure 1:
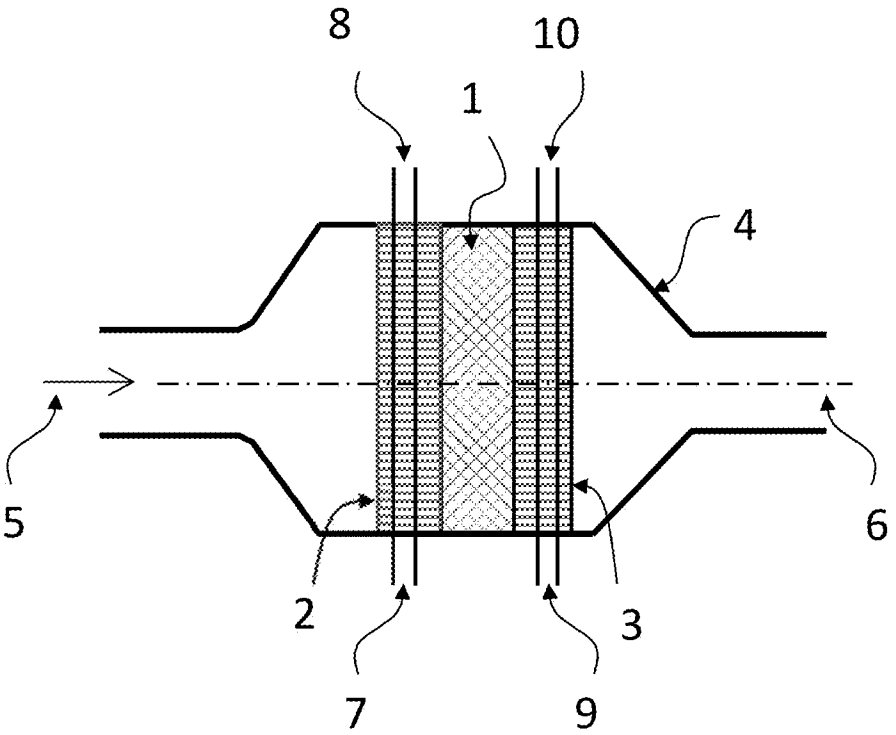
FIG. 1 is a schematic representation of an assembly of a thermoacoustic energy conversion system according to the prior art.

FIG. 1 shows an assembly according to the prior art, which forms part of a thermoacoustic energy conversion system. The assembly comprises a regenerator 1 clamped between a first heat exchanger 2 and a second heat exchanger 3. The assembly is arranged in a closed circumferential encasing 4 that is filled with a working fluid through which an acoustic wave can propagate in a propagation direction 5. Only a part of the encasing 4 is shown in FIG. 1.

The assembly is arranged orthogonal to the local longitudinal axis 6. The heat exchanger 2 is referred to as the first heat exchanger because it is arranged upstream of the regenerator 1 as seen in the propagation direction 5 such that the wave first passes the first heat exchanger 2 and then, via the regenerator 1, the second heat exchanger 3. The first and second heat exchangers 3, 4 comprise connectors 7-10. Each heat exchanger 2, 3 has an inlet connector and an outlet connector for feeding and discharging heat exchange fluid thereto and therefrom, respectively.

Dependent on the function of the assembly as a heat pump or an engine the connectors 7-10 may suitable be chosen as an inlet connector or outlet connector.

Figure 2:
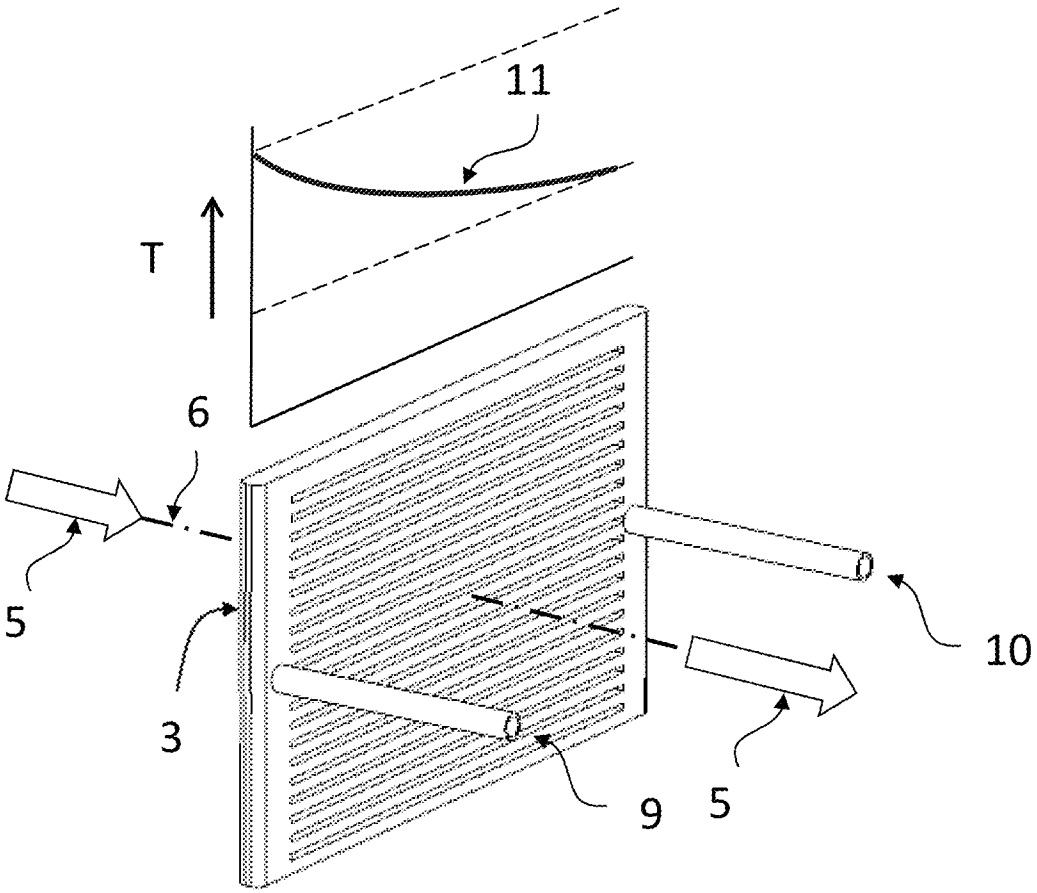
FIG. 2 is a perspective view of a heat exchanger of the assembly of FIG. 1.

FIG. 2 shows the second heat exchanger 3 and the temperature profile 11 thereof in more detail. In this example the connector 9 functions as the fluidic inlet and the connector 10 functions as the fluidic outlet, such that the assembly functions as an engine. As heat is discharged from the heat exchange fluid that flows through the second heat exchanger 3 from the inlet 9 to the outlet 10 the temperature thereof decreases over the length of the second heat exchanger in the direction of the outlet 10. This results in said so-called radial non-uniform temperature distribution as described with respect to the prior art, which violates the wave conditions for optimal performance because thermoacoustic gain declines from the inlet 9 side to the outlet 10 side.

Figure 3:
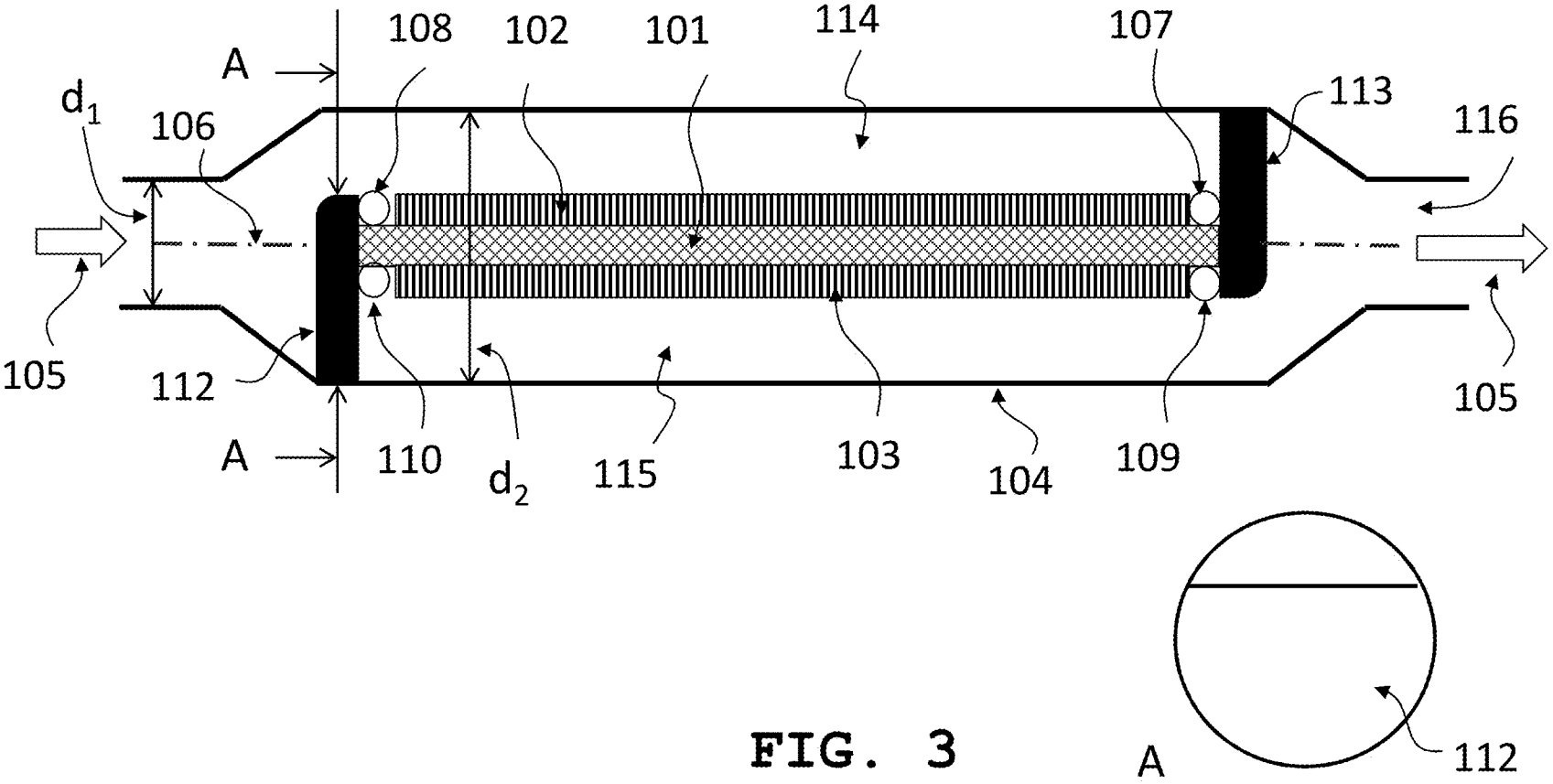
FIG. 3 is a schematic representation of an assembly of a thermoacoustic energy conversion system according to a first embodiment of the invention.

FIG. 3 shows a first embodiment of the system according to the invention in which the assembly, and in particular the first heat exchanger 102, the regenerator 1, and the second heat exchanger 103 are arranged substantially parallel to a local longitudinal axis 106 of the encasing 104, and thereby substantially parallel to the propagation direction 105 of the acoustic wave. Directly upstream of the assembly as seen in the propagation direction 105 a first blocking means 112 is arranged, which first blocking means 112 extends radially inwards from the inner wall of the encasing 104. Usually the encasing has a round cross-section, such that the first blocking means 112 has the shape of a part of a circle as seen in a cross-section orthogonal to the propagation direction 105 and local longitudinal axis 106, as is shown in detail A. The first blocking means 112 blocks a first part of the cross-sectional area of the encasing 104. Directly downstream of the assembly as seen in the propagation direction 105 a second blocking means 113 is arranged, which second blocking means 113 extends radially inwards from the inner wall of the encasing 104. If the encasing 104 is circular in cross-section, the second blocking means has an identical shape to that of the first blocking means 112, but 180° rotated such that it covers a second, opposite part of the cross-sectional area of the encasing 104. The acoustic wave traveling in the propagation direction 105 is blocked first by the first blocking means 112 and at the downstream end of the assembly by the second blocking means 113, which blocking means 112, 113 thereby prevent a bypass of the acoustic wave past the assembly and thereby direct the acoustic wave such that it first passes the first heat exchanger 102 and then, via the regenerator, the second heat exchanger 103. The connector 108 of the first heat exchanger 102, which is arranged at the upstream end of the assembly, is the fluidic inlet for feeding the heat exchange liquid, and the connector 107, which is arranged at the downstream end of the assembly, is the fluidic outlet for discharging the heat exchange liquid. As the heat exchange liquid absorbs heat, the temperature thereof rises over the length of the first heat exchanger 102 from a first, lower temperature at the inlet 108 to a second, higher temperature at the outlet 107. This way, the temperature gradient decreases in the propagation direction 105 of the acoustic wave.

If the assembly functions as an engine the connector 110, which is arranged at the upstream end of the assembly, is the fluidic inlet for feeding the heat exchange liquid and the connector 109, which is arranged at the downstream end of the assembly, is the fluidic outlet for discharging the heat exchange liquid. The liquid fed to the second heat exchanger 103 may for example be heated by surplus heat or by the sun, which heat is discharged to the acoustic wave traveling through the second heat exchanger 103. As the heat exchange liquid discharges heat, the temperature thereof decreases over the length of the first heat exchanger 102 from a first, relatively high temperature at the inlet 110 to a second, lower temperature at the outlet 109. This way, the temperature gradient is largest at the upstream end of the assembly and decreases in the propagation direction 105 of the acoustic wave. Said decreasing temperature gradient over the length of the assembly matches the velocity or acoustic impedance of the wave, thereby providing a more or less uniform power density along the assembly, thereby preventing or at least reducing said unwanted radial acoustic power and thermal flows inside the assembly.

If the assembly functions as a heat pump the connector 109 is the fluidic inlet for feeding the heat exchange liquid and the connector 110 is the fluidic outlet for discharging the heat exchange liquid. The liquid fed to the second heat exchanger 103 discharges heat to the acoustic wave, such that it cools down and may for example be used for cooling a building, i.e. in an airconditioning system of the building. As the heat exchange liquid discharges heat, the temperature thereof decreases over the length of the first heat exchanger 102 from a first, higher temperature at the inlet 109 to a second, relatively low temperature at the outlet 110. This way, the temperature gradient is largest at the upstream end of the assembly and decreases in the propagation direction 105 of the acoustic wave. Said decreasing temperature gradient over the length of the assembly matches the velocity or acoustic impedance of the wave, thereby providing a more or less uniform power density along the assembly, thereby preventing or at least reducing said unwanted radial acoustic power and thermal flows inside the assembly.

As is further shown in FIG. 3, the cross-sectional size, in this embodiment the diameter, of the encasing 104 gradually increases in a downstream direction starting somewhat upstream of the area where said assembly is located and gradually decreases in a downstream direction downstream of said area. The encasing 104 thus has a first, smaller diameter $d_1$ in other areas of said encasing 104 not including said assembly and a second, larger diameter $d_2$ in the area of said assembly. The blocking means 112, 113 block such a part of the cross-sectional through flow area and the first and second heat exchangers 102, 103 are arranged such that the cross-sectional through flow area 114 defined between the inner wall of the encasing 104 and the first heat exchanger 102 and the cross-sectional through flow area 115 defined between the inner wall of the encasing 104 and the second heat exchanger 103 is substantially equal to a cross-sectional through flow area 116 in said other parts of the encasing.

Figure 4:
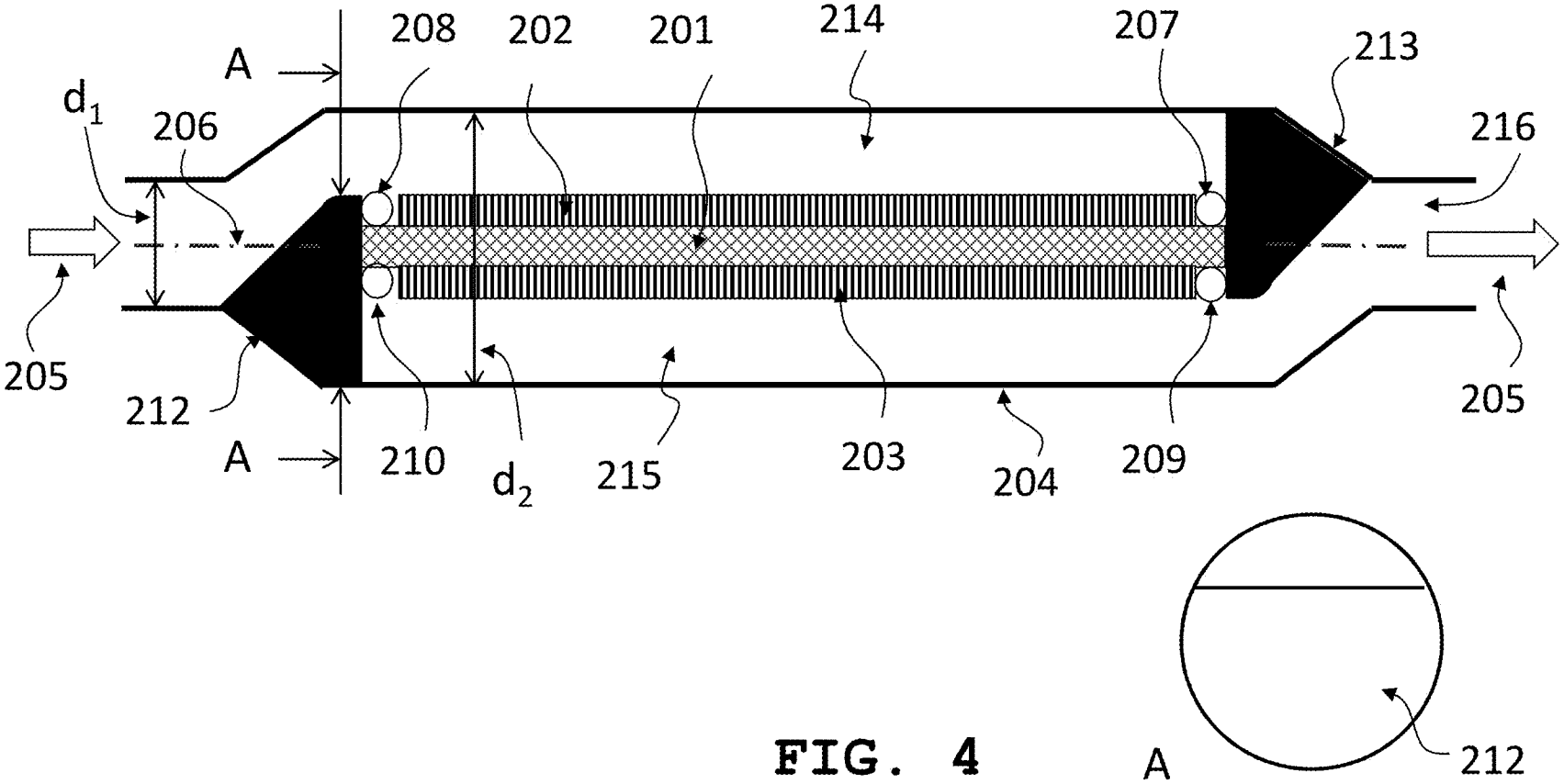
FIG. 4 is a schematic representation of an assembly of a thermoacoustic energy conversion system according to a second embodiment of the invention.

FIG. 4 shows a second embodiment of the system according to the invention. It is noted that only the differences with the embodiment of FIG. 3 will be described here and that for a further description of the second embodiment the reader is referred to the description of FIG. 3. The second embodiment is similar to the embodiment of FIG. 3 and differs only in that the first blocking means 212 gradually rises from an inner wall of the encasing 204 in the propagation direction 205 thereby guiding the acoustic wave in such a manner that it will pass the first heat exchanger 202 first and in that the second blocking means 213 gradually decreases towards the inner wall of the encasing 204 in the propagation direction 205 thereby guiding the acoustic wave in the propagation direction 205.

Figure 5:
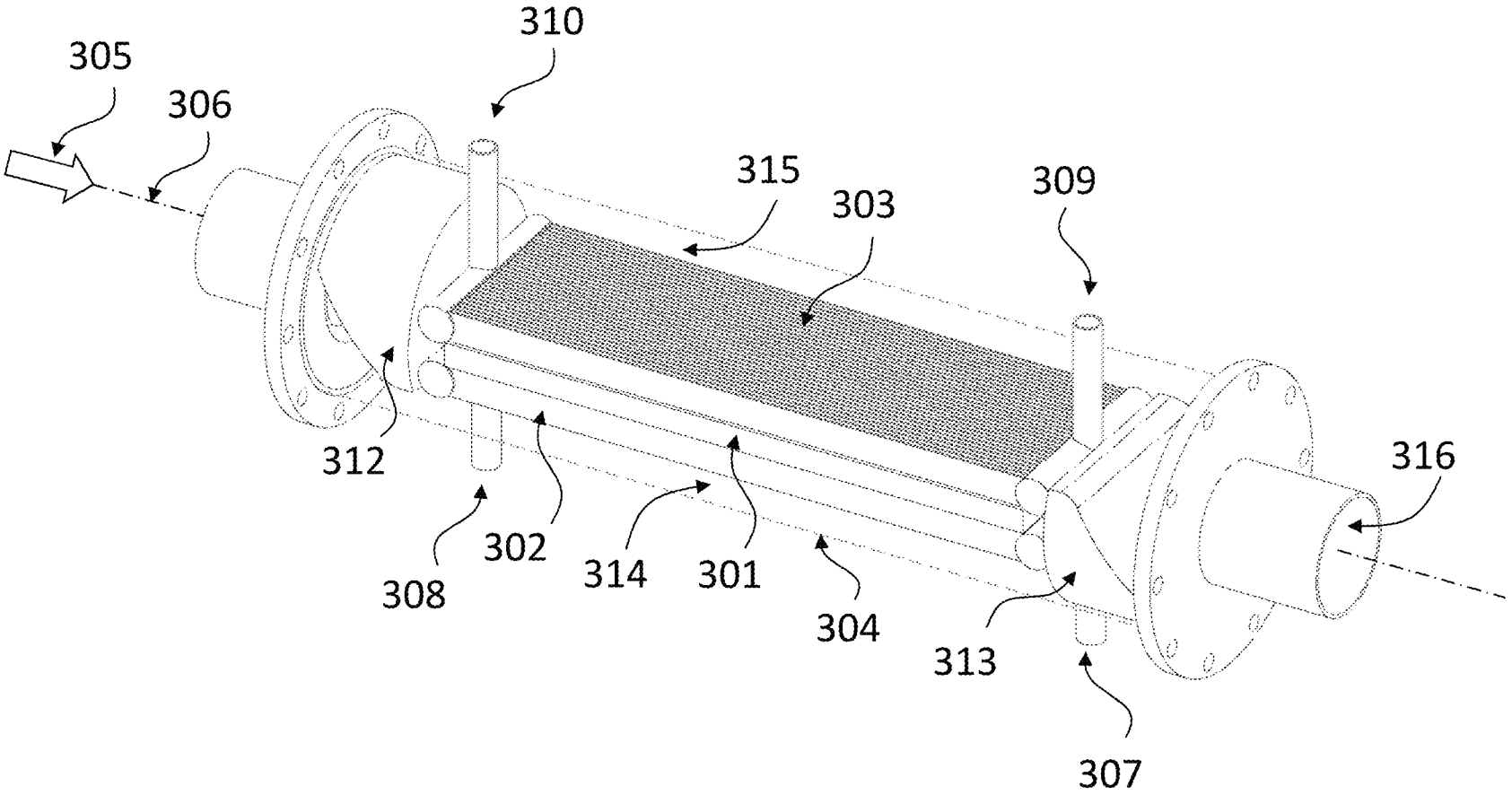
FIG. 5 is a perspective view of an assembly of a thermoacoustic energy conversion system according to a third embodiment of the invention.

FIG. 5 shows a third embodiment of the system according to the invention. It is noted that only the differences with the embodiment of FIG. 3 will be described here and that for a further description of the second embodiment the reader is referred to the description of FIG. 3. The third embodiment is similar to the embodiment of FIG. 3 and differs only in that the first blocking means 312 gradually rises from an inner wall of the encasing 404 in the propagation direction 305 thereby guiding the acoustic wave in such a manner that it will pass the first heat exchanger 302 first and in that the second blocking means 313 gradually decreases towards the inner wall of the encasing 304 in the propagation direction 305 thereby guiding the acoustic wave in the propagation direction 305. The first and second blocking means 312, 313 are further shaped such that the cross-sectional through flow area remains substantially constant over the length of the first and second blocking means 312, 313. This way, the cross-sectional through flow area is substantially constant and in particular equal in the other areas not including the assembly, in the area of the blocking means, in the area defined between the inner wall of the encasing 304 and the first heat exchanger 302, and in the area defined between the inner wall of the encasing 304 and the second heat exchanger 303.

Figure 6:
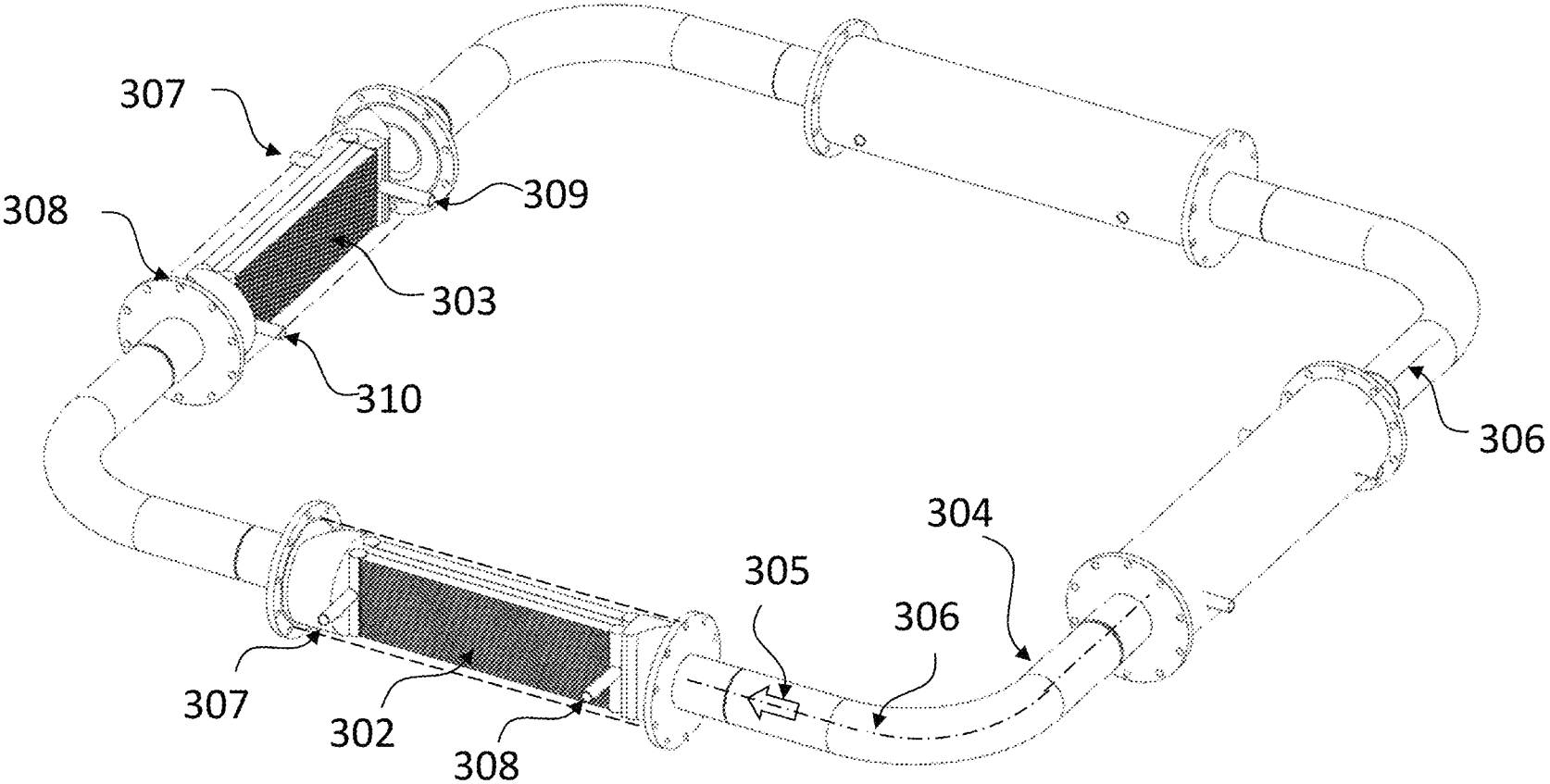
FIG. 6 is a perspective view of a thermoacoustic energy conversion system comprising a plurality of assemblies according to FIG. 5.

FIG. 6 shows that the encasing 304 has as a looped shaped and is a circumferential encasing. Said encasing 304 includes four of the assemblies of the third embodiment of FIG. 5, which are spaced apart in the longitudinal direction 306 of said encasing 304 by preferably equal spacing distances. Two or three of said four assemblies function as an engine, driving the other one or two assemblies that function as a heat pump. The function of each assembly may be chosen by feeding a suitable heat exchange liquid with a suitable inlet temperature to the second heat exchanger 303 and by using the connector 310 at the upstream end as the inlet and the connector 309 at the downstream end as the outlet for the engine, or by using the connector 309 at the downstream end as the inlet and the connector 310 at the upstream end as the outlet for the heat pump. The average total circumferential length of the encasing 304, which is measured along the central longitudinal axis 306 of the encasing 304, is preferably chosen in accordance with the working fluid and the acoustic wave generated therein, and is approximately equal to the wavelength. The length of each assembly is at least 5%, preferably at least 10%, more preferably at least 15% of this average total circumferential length of the encasing 304 and thereby of the wavelength.

It is noted that in the figures the cross-sectional through flow area defined between the inner wall of the encasing and the first or second heat exchanger is substantially constant over the length of each heat exchanger. Alternatively, the cross-sectional through flow area may vary over the length of the heat exchangers, wherein the cross-sectional through flow area may in particular be adapted to local temperatures and acoustical conditions.

It is further noted that the invention is not limited to the shown embodiments but also extends to variants within the scope of the appended claims.

The invention claimed is:

1. A thermoacoustic energy conversion system, comprising:

a circumferential encasing that is filled with a working fluid between a first portion and a second portion, through which an acoustic wave can propagate in a propagation direction defined by the thermoacoustic energy conversion system, and at least one assembly of two heat exchangers with a regenerator sandwiched there between arranged in said encasing, wherein a local longitudinal axis of said encasing is substantially parallel to the propagation direction, and wherein respective planes formed by the contact between the two heat exchangers and the regenerator of said at least one assembly are substantially parallel to the local longitudinal axis of said encasing, and are also substantially parallel to the propagation direction of the acoustic wave at the first portion;

wherein said circumferential encasing includes a first blocker arranged in said encasing for blocking a first part of the cross-sectional area of the encasing upstream of said assembly as seen in said propagation direction, and a second blocker arranged in said encasing for blocking a second, opposite part of the cross-sectional area of the encasing downstream of said assembly as seen in said propagation direction, wherein said first and second blockers are arranged to prevent said acoustic wave from bypassing said assembly and to direct the acoustic wave in a directing direction to first pass a first heat exchanger of the two heat exchangers and then, via the regenerator, the second heat exchanger of the two heat exchangers.

2. The thermoacoustic energy conversion system according to claim 1, wherein said first blocker gradually rises from an inner wall of the encasing in the propagation direction, thereby guiding said acoustic wave in said directing direction.

3. The thermoacoustic energy conversion system according to claim 1, wherein said second blocker gradually decreases towards the inner wall of the encasing in the propagation direction, thereby guiding said acoustic wave in the propagation direction.

4. The thermoacoustic energy conversion system according to claim 2, wherein said encasing has an increased cross-sectional size in in the area of said assembly with respect to other parts of said encasing, wherein upstream of said assembly as seen in said propagation direction the cross-sectional size of the encasing gradually increases to said increased size, and wherein downstream of said assembly as seen in said propagation direction the cross-sectional size of the encasing gradually decreases to its size in said other parts, wherein at least one of said first blocker and said second blocker is/are arranged in the gradually increasing part, respectively decreasing part of said encasing, and wherein said at least one of said first blocker and said second blocker gradually rises, respectively decreases in such a manner that the cross-sectional through flow area of said encasing in said increasing part, respectively decreasing part remains substantially constant over the length of the at least one of said first and second blockers and is substantially equal to a cross-sectional through flow area in said other parts of the encasing.

5. The thermoacoustic energy conversion system according to claim 1, wherein said encasing has an increased cross-sectional size in in the area of said assembly with respect to other parts of said encasing, wherein upstream of said assembly as seen in said propagation direction the cross-sectional size of the encasing gradually increases to said increased size, and wherein downstream of said assembly as seen in said propagation direction the cross-sectional size of the encasing gradually decreases to its size in said other parts, and wherein a cross-sectional through flow area defined between at least one of the inner wall of the encasing and the first heat exchanger and between the inner wall of the encasing and the second heat exchanger is substantially equal to a cross-sectional through flow area in said other parts of the encasing.

6. The thermoacoustic energy conversion system according to claim 1, wherein an inlet for feeding a heat exchange fluid to the first heat exchanger is arranged at an upstream end of the first heat exchanger as seen in the propagation direction, and wherein the outlet for discharging said heat exchange fluid from the first heat exchanger is arranged at a downstream end of the first heat exchanger as seen in the propagation direction.

7. The thermoacoustic energy conversion system according to claim 1, wherein an inlet for feeding a heat exchange fluid to the second heat exchanger is arranged at an upstream end of the second heat exchanger as seen in the propagation direction, and wherein the outlet for discharging said heat exchange fluid from the second heat exchanger is arranged at a downstream end of the second heat exchanger as seen in the propagation direction.

8. The thermoacoustic energy conversion system according to claim 1, wherein an inlet for feeding a heat exchange fluid to the second heat exchanger is arranged at a downstream end of the second heat exchanger as seen in the propagation direction, and wherein the outlet for discharging said heat exchange fluid from the second heat exchanger is arranged at an upstream end of the second heat exchanger as seen in the propagation direction.

9. The thermoacoustic energy conversion system according to claim 1, comprising a plurality of said assemblies that are spaced apart in the longitudinal direction of said encasing.

10. The thermoacoustic energy conversion system according to claim 1, wherein a length of said or each of said assembly is at least 5% of an average total circumferential length of the encasing.

11. The thermoacoustic energy conversion system according to claim 9, wherein the plurality of said assemblies that are spaced apart in the longitudinal direction of said encasing are spaced apparat by equal spacing distances.

12. The thermoacoustic energy conversion system according to claim 10, wherein a length of said or each of said assembly is at least 10% of the average total circumferential length of the encasing.

13. The thermoacoustic energy conversion system according to claim 10, wherein a length of said or each of said assembly is at least 15% of the average total circumferential length of the encasing.

* * * * *